United States Patent [19]

Pape et al.

[11] 3,999,644

[45] Dec. 28, 1976

[54] PRINTING DEVICE COMPRISING RECORDING PINS

[75] Inventors: Johannes Gerhardus Pape; Theodorus Gerhardus Potma; Jan Post, all of Rijswijk, Netherlands

[73] Assignee: U.S. Philips Corporation, New York, N.Y.

[22] Filed: May 14, 1975

[21] Appl. No.: 577,352

Related U.S. Application Data

[63] Continuation of Ser. No. 379,809, July 16, 1973, abandoned, which is a continuation of Ser. No. 255,530, May 22, 1972, abandoned.

[30] Foreign Application Priority Data

May 26, 1971 Netherlands ..... 7107209

[52] U.S. Cl. ..... 197/1 R; 101/93.05

[51] Int. Cl.[2] ..... B41J 1/18

[58] Field of Search ..... 197/1 R; 101/93.04, 101/93.05; 178/23

[56] References Cited

UNITED STATES PATENTS

| | | | |
|---|---|---|---|
| 2,674,652 | 4/1954 | Johnson et al. | 101/93.04 X |
| 2,869,455 | 1/1959 | Knutsen | 197/1 X |
| 3,625,142 | 12/1971 | Bresler | 197/1 X |
| 3,729,079 | 4/1973 | Zenner et al. | 197/1 |

*Primary Examiner*—Ralph T. Rader
*Attorney, Agent, or Firm*—Frank R. Trifari; Robert S. Smith

[57] ABSTRACT

A printing device for printing characters, composed of dot-like or line-like elements, by means of recording pins which are driven by electromagnets. The recording pins are connected to the armature of the electromagnets and are guided in a bar which can be displaced in front of a recording sheet. The electromagnets are also accommodated in this bar.

9 Claims, 4 Drawing Figures

PRINTING DEVICE COMPRISING RECORDING PINS

This is a continuation of application Ser. No. 379,809, filed July 16, 1973, now abandoned; which was a continuation of Ser. 255,530 filed May 22, 1972, now abandoned.

The invention relates to a printing device for printing characters which are composed of dot-like or line-like elements, comprising a recording pin which is slidably guided in a bar-shaped member which can be moved to and fro in front of a recording sheet, it being possible to press said pin against the recording sheet under the influence of electrical control pulses from an electromagnet.

In known printing devices of the kind set forth the recording pins are formed by comparatively long, flexible metal rods which together constitute a wafer of recording pins which converges towards the recording sheet. In the vicinity of the recording sheet the recording pins are slidably guided in a bar which can be moved to and fro in a direction transverse to the direction of movement of the recording sheet. The end of the recording pins which is remote from the recording sheet is connected to the "armature" of a stationary electromagnet. Between the stationary electromagnets and the bar which can be moved to and fro, each recording pin is also slidably guided in curved, stationary supports.

One of the drawbacks of the described known printing device is that the recording pins are subject to substantial wear due to friction in the curved supports, which results in a comparatively short service life of the pins and decreasing efficiency of the printing device. A further drawback is that a long recording pin having a comparatively large mass is required because of the comparatively long distance between the electromagnets and the recording sheet. The acceleration of this mass requires substantial energy and necessitates the use of comparatively large electromagnets.

The invention has for its object to eliminate the said drawbacks.

To this end, the invention is characterized in that the bar-shaped member comprises a plurality of comparatively short recording pins which are arranged to be mutually parallel at a uniform distance from each other, each of said recording pins being connected to the armature of a corresponding electromagnet which is supported by the bar-shaped member.

In a preferred embodiment of the printing device according to the invention, the recording pins are arranged in a number of series of recording pins which are also arranged at a mutually equal distance, the line segment connecting the centres of the recording pins arranged in one series extending at an angle with respect to the longitudinal direction of the bar-shaped member.

The invention will be described in detail with reference to the drawings, in which.

Figure 1:
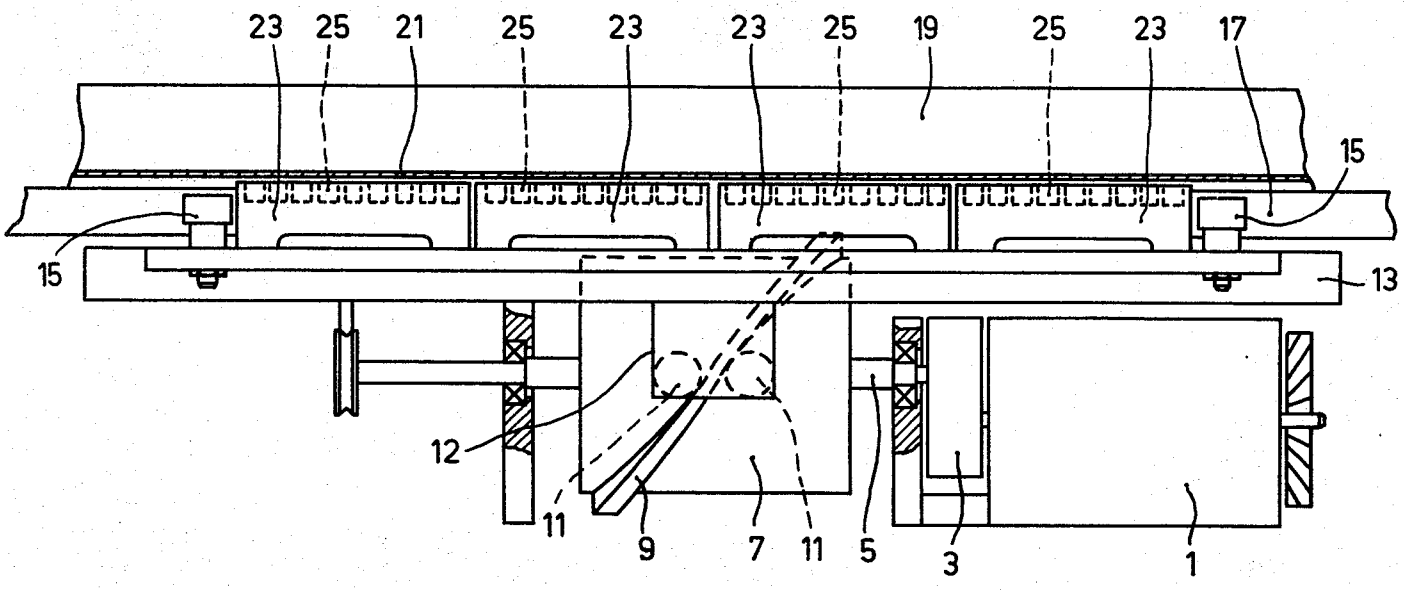
FIG. 1 is a partial sectional plan view of a printing device according to the invention.
Figure 2:
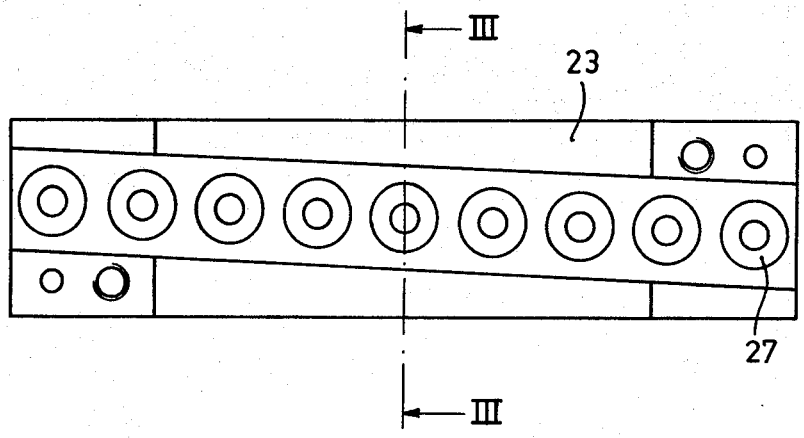
FIG. 2 shows an enlarged detailed view of a portion of the bar-shaped member shown in FIG. 1.
Figure 3:
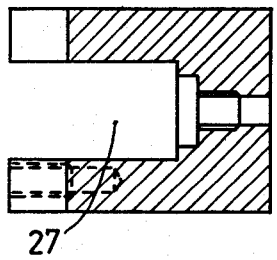
FIG. 3 shows a cross-section taken along the line III—III of the detailed view according to FIG. 2.

The preferred embodiment of a printing device according to the invention which is shown in FIG. 1 comprises an electric motor 1 which is coupled, via a speed reduction device 3, to a drive shaft 5 to which a drive roller 7 is connected. The drive roller 7 is provided along its circumference with a helical cam 9 which engages a roller pair 11 mounted on a strip 12 which is connected to the bar 13. The bar 13 is guided on a horizontal path 17 by means of rollers 15. When the drive roller 7 rotates, the bar 13 is moved to and fro in a horizontal plane in front of a roller 19 on which a recording sheet 21 is guided in a direction transverse to the direction of movement of the bar 13. The means for transporting the recording sheet 21 are of a commonly used kind and are not shown in FIG. 1. The bar 13 comprises four holders 23 in which respective series of nine electromagnets 25 and their recording pins are accommodated. The helical cam 9 on the drive roller 7 is proportioned such that two full line widths can be printed on the recording sheet 21 during one revolution of the drive roller 7. Between the recording sheet 21 and the holders 23 a transportable ink tape (not shown) is provided in the usual manner. However, it is alternatively possible to dispense with the ink tape and to use a pressure-sensitive recording sheet. In the printing device shown in FIG. 1, a character is printed from a matrix of 9×7 possible circular printing points. As is shown in FIG. 2 (see also FIG. 3), each holder 23 comprises 9 fittings 27, arranged at mutually equal distances from each other, for the electromagnets 25. The line segment connecting the centres of the nine electromagnets extends at an angle with the longitudinal direction of the holder 23 and the longitudinal direction of the bar 13 shown in FIG. 1. The height of a character to be printed is equal to approximately $8 \times 0.4 = 3.2$ mm, as is common in the case of a $9 \times 7$ matrix, so that the vertical distance in FIG. 2 between the centres of the extreme left-hand and the extreme right-hand electromagnet is also 3.2 mm. Each recording pin driven by a given electromagnet always prints points of the same level in the different characters to be successively printed on a line. The stroke to be completed by bar 13 for printing a full line width can be reduced by increasing the number of holders 23. In the present case the line width is such that it can be covered, using four holders 23, in one stroke of the bar 13 to be described hereinafter.

Figure 4:
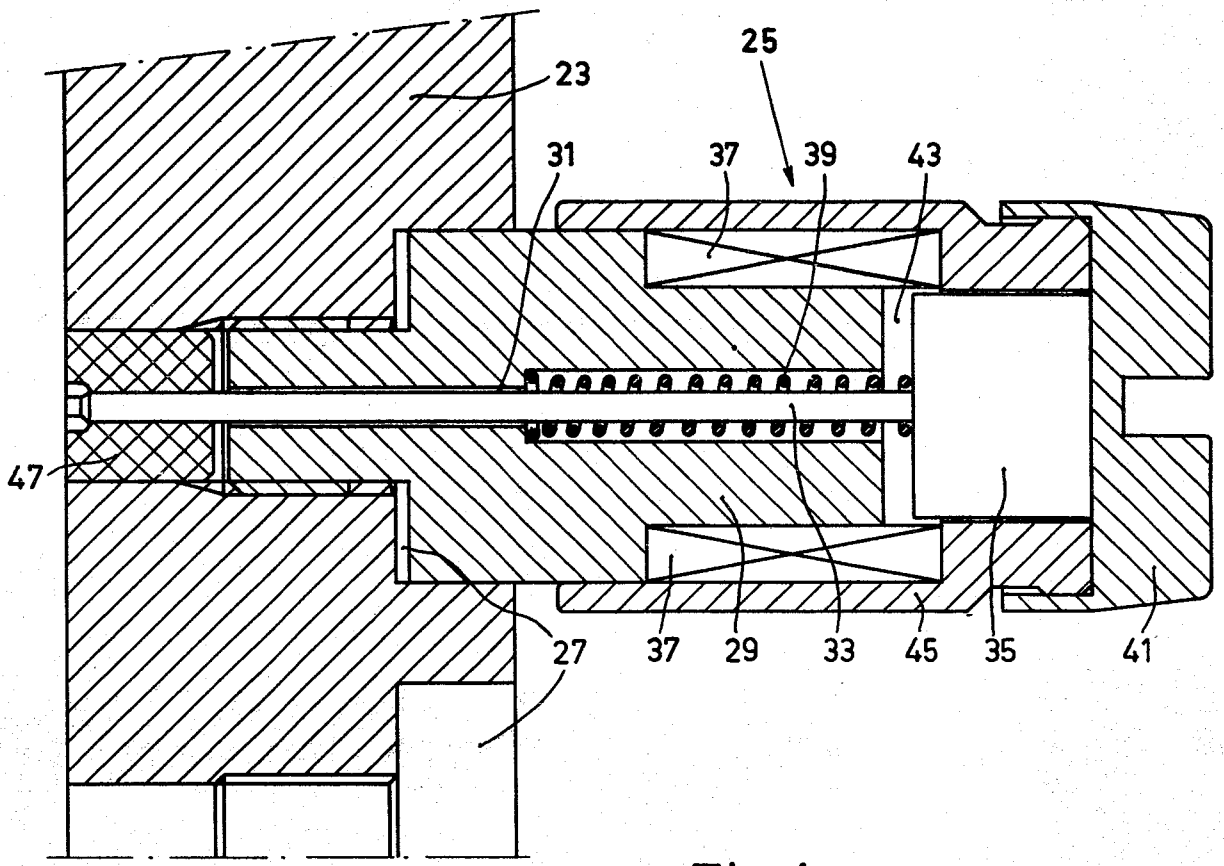
FIG. 4 shows an enlarged cross-sectional view of FIG. 3 with one of the electromagnets in the mounted condition.

In the holder 23 shown in FIG. 4 a magnet core 29 is screwed into the fitting 27, said core being provided with a bore-hole 31. The bore-hole 31 forms part of the guide for a short, straight recording pin 33 which is connected to an armature 35 of a magnetically conductive material. Provided about the magnet core 29 is an excitation coil 37. The armature 35 which is connected to the recording pin 33 bears against a screw cap 41 under the force of a reset spring 39 which is provided about the recording pin 33. In the non-energized state of the coil 37, an air gap 43 is present between the magnet core 29 and the armature 35. The magnetic circuit formed by the magnet core 29, the air gap 43 and the armature 35 is closed by a collar 45 which is made of a magnetically conductive material and which is encompassed by the screw cap 41. The end of the recording pin which is remote from the armature 35 is guided in a guide block 47 which is provided in the holder 23. When the coil 37 is energized, the armature 35 is pulled against the magnet core 29 so that the recording pin 33 reaches the printing position.

The minimum stroke of the bar 13 and hence of the holders 23 is determined by the centre-to-centre distance between two successive electromagnets or recording pins, projected in the longitudinal direction of the bar 13. In the printing device shown in the FIGS. 1 and 2, the projected centre-to-centre distance between two successive electromagnets is approximately 7.5 mm. Because comparable recording pins in successive holders must be capable of covering their mutual distance, the minimum stroke of the bar 13 must be at least $7.5 \times 9 = 67.5$ mm. As it is structurally impossible to arrange the last recording pin in a holder below the first recording pin of the subsequent holder, the ultimate minimum stroke does not amount to 67.5 mm but to approximately 75 mm.

In a further embodiment of a printing device according to the invention all electromagnets are arranged in a line which extends parallel to the longitudinal direction of the bar. The advantage of this embodiment is that the logic equipment by which the printing device is controlled can be less complicated than in the case of magnets which are arranged at an angle with respect to the bar direction. In this case, the minimum stroke of the bar is determined exclusively by the centre-to-centre distance of two successive electromagnets. This centre-to-centre distance must be covered by each recording pin. In the case of a centre-to-centre distance of 7.5 mm between the electromagnets, the minimum stroke of the bar is also 7.5 mm which corresponds to 3 character widths in a 9×7 matrix as described and two spaces. The character to be printed is then formed by making the recording pin, used for the entire character, print respective the points which are situated on one line in the character, proceding from the top downwards in the point matrix of the character. The paper transport can both be intermittent and continuous. In the case of continuous paper transport, the printing frequency must be so high that any visible angle between the line direction and the edge of the recording sheet is avoided. So as to prevent such a slanted line on the recording sheet, the bar can be made to move at an angle with respect to the line direction, so that a movement component of the bar is obtained in the direction of movement of the recording sheet.

Instead of composing a character from a matrix comprising 9×7 printing positions, a matrix comprising 7×5 printing positions or other commonly used matrices can be chosen. The shape of the points to be printed will generally be circular, but may of course also be line-like.

A flexible strip with printed wiring is used for establishing the electrical connections between the coils 37 of the electromagnets 25 and the stationary logic equipment.

Finally, it is to be noted that in printing devices which utilize a small line width, such as is the case in desk computers, the number of holders for the electromagnets can be restricted to one.

What is claimed is:

1. A printing device for printing characters composed of a mosaic of discrete marks on an associated recording sheet which is transported in a given direction, comprising a holder carrying a plurality of elongated rectilinear recording pins, all of said pins within an axial section of said holder being carried in said holder in coplanar relationship, each of said pins within said axial section of said holder, being equally spaced from each adjacent pin a first distance greater than the distance between adjacent points of a character, each of said pins within said axial section being parallel to each other pin and disposed with the longitudinal dimension thereof substantially perpendicular to the surface of the associated recording sheet, a number of actuating means mounted on said holder, each of said actuating means cooperating with one of said recording pins for selective displacement thereof along the longitudinal axis thereof in response to an electrical signal, said pins remaining rectilinear during said displacement, and means for moving said holder a second distance at least equal to the width of a character in a direction approximately transverse to said given direction.

2. The printing device of claim 1, wherein said means for moving comprises a carrier bar mounting a plurality of said holders thereon so that said plurality of holders may be moved in unison in said approximately transverse direction.

3. The printing device of claim 1, wherein the ends of the recording pins proximate the recording sheet are disposed along a straight line extending at an angle with respect to the direction of movement of said holder.

4. The printing device of claim 1, wherein said actuating means comprises an electromagnet coil having a central bore through which said associated recording pin extends, and a spring-biased cylindrical magnetic armature connected to an end of said pin for moving said pin upon electrical energization of said coil by said electric signal, said coil and armature being coaxially arranged with respect to said recording pin.

5. A printing device for printing characters composed of a mosaic of discrete marks upon an associated recording sheet, said printing device comprising:

means for moving the associated recording sheet in a first direction;

a bar containing a plurality of holders disposed adjacently to said recording sheet;

a plurality of generally cylindrical electromagnets carried by each holder;

a plurality of elongated rectilinear recording pins, all of said pins within an axial section of said holder being mutually parallel and coplaner and centrally disposed within a respective electromagnet, each end of each recording pin in a respective holder within an axial section of said holder being disposed in mutually aligned relationship to define a line that is oblique with respect to said first direction;

guide means disposed in said holders adjacent each electromagnet for guiding each respective recording pin independently of each other, substantially concentric to its respective electromagnet, and substantially normal to said recording sheet along rectilinear paths, said pins remaining coplanar and rectilinear for their entire longitudinal extent throughout the entire travel thereof; and means for reciprocating said bar in a direction transverse to said first direction.

6. A printing device for printing characters composed of a mosaic of discrete marks upon an associated recording sheet being moved in a first direction, said printing device comprising:

a bar containing at least one holder disposed adjacently to said recording sheet;

a number of elongated substantially rectilinear recording pins supported by each holder, all of said pins within an axial section of said holder being substantially parallel to each other and coplanar and rectilinear throughout the travel of said pins;

a number of electromagnets supported by said bar, each electromagnet selectively activating one of said recording pins;

substantially straight guide means for the recording pins arranged within said holder substantially normal to the recording sheet for guiding said pins in rectilinear paths; and means for reciprocating longitudinally said bar substantially in a direction transverse with respect to said first direction.

7. The printing device of claim 6 wherein said electromagnets are disposed upon said bar in a plane which is in oblique relationship to said first direction.

8. A matrix printer for cooperation with an associated recording sheet comprising: a platen providing a guiding surface for the associated recording sheet, the recording sheet being movable in a first direction with respect to said platen, a carrier member supported for reciprocable movement parallel to the axis of said platen and transverse to the direction of movement of said recording sheet, said carrier member carrying for longitudinal movement a plurality of rectilinearly guided elongated rectilinear printing pins arranged in spaced parallel coplanar relationship with their longitudinal direction substantially perpendicular to the surface of said platen, the free ends of each of said pins adjacent said platen upon longitudinal displacement of said pin forming an imprint on said recording sheet, the other end of each pin being directly connected to one of a plurality of individual electrically controlled driving means, each of said driving means being fixed on said carrier member for concurrent transverse movement with respect to said first direction all of said pins being coplanar, mutually parallel and rectilinear at all times and positions and throughout the longitudinal extent of said pins within an axial section of said carrier member.

9. The printing device of claim 8, wherein said driving means comprises coaxially disposed electromagnets, each of said electromagnet supporting said coaxially disposed printing pin.

* * * * *